US005971138A

United States Patent [19]

Soughan

[11] Patent Number: 5,971,138

[45] Date of Patent: Oct. 26, 1999

[54] TOILETRIES DISPENSING PACKAGE

[76] Inventor: John J. Soughan, 33 E. Orange St., Chagrin Falls, Ohio 44022

[21] Appl. No.: 09/035,543

[22] Filed: Mar. 5, 1998

[51] Int. Cl.[6] ..... B65D 81/24; B65D 85/67; B65D 27/10

[52] U.S. Cl. ..... 206/210; 206/390; 206/812; 206/820; 221/63; 229/69

[58] Field of Search ..... 206/209, 210, 206/390, 494, 820, 812; 221/63; 15/104.93, 104.94; 383/37; 229/69

[56] References Cited

U.S. PATENT DOCUMENTS

| | | | |
|---|---|---|---|
| Re. 29,052 | 11/1976 | Bucalo . | |
| D. 377,284 | 1/1997 | Farrow et al. . | |
| 2,102,858 | 12/1937 | Schlumbohm . | |
| 3,057,467 | 10/1962 | Williams . | |
| 3,162,539 | 12/1964 | Repko | 206/820 X |
| 3,181,734 | 5/1965 | Ensign | 206/390 X |
| 3,199,756 | 8/1965 | Davy | 206/390 X |
| 3,254,828 | 6/1966 | Lerner | 383/37 |
| 3,263,904 | 8/1966 | Warp | 383/37 X |
| 3,348,762 | 10/1967 | Kasinkas | 206/390 X |
| 3,456,867 | 7/1969 | Repko . | |
| 3,482,763 | 12/1969 | Corrigan | 229/69 |
| 3,485,349 | 12/1969 | Chaney, Jr. . | |
| 3,613,142 | 10/1971 | Chaney, Jr. . | |
| 3,674,135 | 7/1972 | Simon . | |
| 3,734,277 | 5/1973 | Bucalo . | |
| 3,749,237 | 7/1973 | Dorton | 206/390 X |
| 3,827,552 | 8/1974 | Janhonen . | |
| 3,921,802 | 11/1975 | Thompson . | |
| 4,004,687 | 1/1977 | Boone . | |
| 4,015,771 | 4/1977 | Sengewald . | |
| 4,017,002 | 4/1977 | Doyle et al. . | |
| 4,106,616 | 8/1978 | Boone . | |
| 4,106,617 | 8/1978 | Boone . | |
| 4,235,333 | 11/1980 | Boone . | |
| 4,337,876 | 7/1982 | Thompson . | |
| 4,428,477 | 1/1984 | Cristofolo . | |
| 4,550,855 | 11/1985 | Harrison . | |
| 4,816,320 | 3/1989 | St. Cyr . | |
| 4,837,088 | 6/1989 | Freedman . | |
| 4,863,772 | 9/1989 | Cross . | |
| 4,883,197 | 11/1989 | Sanchez et al. . | |
| 4,884,719 | 12/1989 | Levin et al. . | |
| 4,925,714 | 5/1990 | Freedman . | |
| 4,986,673 | 1/1991 | Bell . | |
| 5,014,856 | 5/1991 | Griesbach et al. . | |
| 5,085,655 | 2/1992 | Mann et al. . | |
| 5,135,146 | 8/1992 | Simhaee . | |
| 5,219,424 | 6/1993 | Simhaee . | |
| 5,311,986 | 5/1994 | Putz . | |
| 5,328,053 | 7/1994 | Cook et al. | 221/63 |
| 5,335,478 | 8/1994 | Aronsen . | |
| 5,361,936 | 11/1994 | Cook | 221/63 |
| 5,409,116 | 4/1995 | Aronsen . | |
| 5,439,521 | 8/1995 | Rao . | |
| 5,473,789 | 12/1995 | Oster . | |
| 5,611,482 | 3/1997 | Gaetano . | |

FOREIGN PATENT DOCUMENTS

| | | | |
|---|---|---|---|
| 2674824 | 10/1992 | France | 206/390 |

OTHER PUBLICATIONS

Advertisement containing the phrase "The Cleaner You Are, the Better You'll Feel!" and bearing the notation "Copyright ©1997, NuWay Corporation. Jul. 1997", 1 page.

"Field Noties Hot Starts", Phaedra Hise, Inc., Apr. 1997, p. 21.

*Primary Examiner*—Bryon P. Gehman

*Attorney, Agent, or Firm*—Pearne, Gordon, McCoy & Granger LLP

[57] ABSTRACT

A plurality of wipe-containing moisture-resistant flapped envelopes are interconnected end-to-end to form a train of envelopes stored in roll form and containing wipes or towelettes treated with cleanser or other skin-treating agent. Each flap is held closed in the roll until the flap's associated envelope is unrolled from the end of the roll, whereupon the flap falls open and the envelope's contents may be easily removed without any need for peeling or unzipping the flap.

8 Claims, 1 Drawing Sheet

TOILETRIES DISPENSING PACKAGE

This invention relates to toiletries on a roll (hereinafter referred to as a toiletry roll) of the type comprising a train of separable packets or envelopes made of moisture-resistant polymeric film material, the envelopes containing towelettes or wipes, the latter being moisturized with, i.e., soaked with or containing, a skin-treating agent or agents, the envelopes being intended to be torn from the end of the unwinding roll and opened for use of the towelettes or wipes contained in them for personal hygiene.

BACKGROUND

Toiletry rolls of the above general type have long been known, and are intended to have a range of uses for cleaning the skin. A particular advantageous use for products of this type is as a cleanser or wipe for the anal region in place of conventional toilet paper, or as a supplement thereto. Another use is for hand or facial cleansers. The term "toiletry" as used herein is to be understood to refer to the full range of uses, and not only to uses associated with elimination.

One example of a known product of this kind is shown in U.S. Pat. No. 3,485,349 to Chaney. A plurality of separable packets of moisture-tight material are interconnected in end-to-end succession, each packet comprising an outer "overwrap" containing an inner "impregnated" or moisturized "applicator" (towelette or wipe). The overwrap is sealed around the moistened applicator, providing a moisture-tight envelope for it. The opening of the overwrap to expose the applicator must be accomplished by separating the two layers of the overwrap, as by gripping the two juxtaposed layers of the overwrap and peeling them apart (col. 3, lines 61–75). This requires two hands and is a relatively awkward manipulation.

Another example of a product of the same general kind as the present invention is shown in U.S. Pat. No. 5,335,478 to Aronsen. Again, the packets are sealed all around and must be opened by a manipulatively awkward peeling apart or separation of layers, involving in this case manipulation of lift tab 110 of an adhesive closure flap to raise a closure face coated with resealable adhesive 108 (col. 6, lines 6–17).

Still another example of a product of the same general kind as the present invention is shown in U.S. Pat. No. 3,921,802 to Thompson. Here, each moisture resistant packet comprises moisture resistant coatings or films 1*a* and 3*a* (FIG. 2) forming an envelope around the moist pad or wipe 2. The packet is opened by grasping the tab 4 with one hand and tearing off the sheet 3 (carries waterproof film 3*a*) with the other hand (col. 2, lines 21–23).

The present invention improves on these and other similar prior products by providing wipe-containing packets or envelopes which surround the wipes with a moisture-resistant barrier but which do not have to be opened by manipulation with two hands, or which can be more conveniently opened than the prior art devices. The result is improved convenience in the use of a product of this general type.

The objects and advantages of the invention will be more clearly understood from the following detailed disclosure.

DETAILED DESCRIPTION OF THE INVENTION

Figure 1:
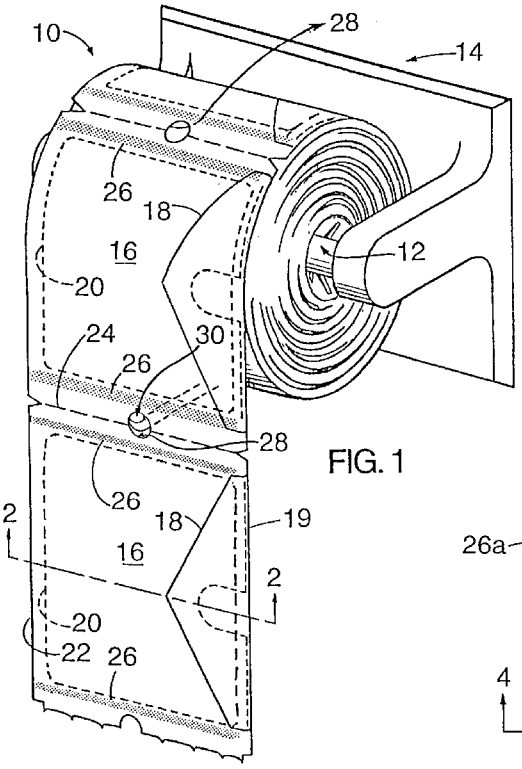
FIG. 1 is an isometric view of a mounted toiletry roll embodying the invention.

In the embodiment of FIG. 1, a roll 10 of toiletries is mounted on the spindle 12 of a toilet roll type fixture 14. The roll 10 comprises a series of envelopes 16 arranged end to end, two of which can been seen facially in the drawing. These envelopes are formed of flexible polymeric moisture-resistant film material which is preferably heat-sealable to itself along selected lines of joinder, or is capable of being welded to or adhered to itself along such lines by other means, including pressure-sensitive adhesive or other adhesive pattern-coated between the two faces of each envelope. The envelopes 16 are arrayed end-to-end to form a train of envelopes. Each envelope 16 has a closure flap 18. In the assembled and wound-up toiletry roll 10, the closure flaps are folded inwardly around hinge line 19 to envelope-closing position, preferably with the flaps on the radially outer sides of the envelopes, as shown in the drawing. The flaps are held tightly closed by the wound configuration.

Each of the envelopes in the embodiment of FIG. 1 contains one flushable towelette or wipe 20, each wipe being moistened with (i.e. soaked with or containing) at least one skin-treating agent or toiletry such as an emollient, skin cleanser, skin washing fluid or detergent, skin conditioner, skin lotion, bactericide or anti-pathogenic agent, deodorizer or scent. In some instances, the inclusion of more than one agent in a single wipe will be difficult, or will be undesirable because one or more of the combined agents will work more effectively alone than combined with another, or will tend to degrade the effectiveness of the agent with which it is combined, or optimum performance of one or more of the combined agents will be otherwise compromised by carrying two or more agents in the same wipes.

In FIG. 1, the top faces of the envelopes 16 are joined to the bottom faces by a folded edge 22. The envelopes are separated by perforation lines 24 extending across the width of the roll and through the two faces of the train of envelopes. Each envelope is closed at one side edge by the folded edge 22. The opposite side edge of each envelope is closed by its associated closure flap 18 as more fully described below. Each envelope is closed near each of its end edges by one of the heat seal lines 26 or by other corresponding weldments or patterned lines of adhesive, or by pressure sealing or cohesion between the two layers of film material at the lines 26 without the use of heat or applied adhesive, or in other equivalent manner. The seals 26 may terminate slightly short of the flap-associated side edge of the envelopes, as shown, or may extend all the way to such side edge.

The envelope side edge from which each flap 18 is folded inwardly corresponds to the side face of the roll 10 that is visible in FIG. 1; the folded edge 22 of each envelope corresponds to the opposite side of the roll 10, i.e., the side that is not visible in FIG. 1. The envelope side edge over which each flap 18 is folded may be provided with a thumbhole or thumb notch, as shown in the drawings.

If desired, a catch hole 28 may be provided, punctured or otherwise formed extending through the two faces of each envelope at the downstream end portion of the envelope. These holes are designed to engage a hook or catch 30 which is preferably supported by and extends from the fixture 14 via a suitable bracket or shank portion (not shown). The catch 30 registers with each succeeding hole 28 when the free end of the roll 10 is trained over the catch, and if the user wishes, he or she can, using only one hand, easily engage the catch with the upper edge of the hole edge and then pull down on the endmost envelope to tear it off at the perf lines 24. Tears tend to start at each lateral edge of the hole and then proceed laterally outwardly to each side edge of the train of envelopes. Preferably, to aid in easy tear starting, a perforation intersects each of the pair of opposed lateral edges of each catch hole 28, as shown in the drawings. In some applications, film strength and tearability and other attributes may allow convenient one-handed tearing apart and separation of each succeeding endmost envelope in the train without the use of a catch of the nature described.

The flaps 18 of the envelopes 16 are in closed position when entrained in the roll 10, thereby enclosing the moist towelettes or wipes 20 to protect them. As previously indicated, the flaps are held tightly in closed position by the rolled configuration of the train.

Figure 2:
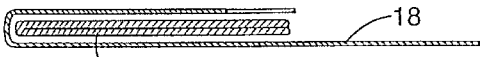
FIG. 2 is a diagrammatic cross-sectional view taken on line 2—2 of FIG. 1, but with the envelope flap open and with elements at the far end (as viewed) of the envelope omitted for simplicity.

In the embodiment in FIGS. 1 and 2, each envelope 16 is closed on its ends by the seal lines 26 and on one side edge by the hinge of the folded edge 22. Each envelope is closed on the other side edge by the hinge 19 of the flap 18 and the flap itself, particularly the flap portions adjacent the flap hinge line. As previously indicated, the seals 26 may terminate just short of the flap hinge edge, as shown in FIG. 1, or may extend all the way to the flap hinge edge. Elections between these alternative and between other similar alternatives may be made to better balance any performance tradeoffs that may be presented for a particular film material, such as a tradeoff between good closure on the one hand and ease of use on the other.

As indicated above, it is presently preferred to fold the flaps over the outer faces of the envelopes, as shown in FIG. 1; in other words the closed flaps are on the radially outer side of the train of envelopes making up the roll 10. This tends to contribute to the maintenance of the snugness of the closure of each envelope by its associated flap in the entrained roll of envelopes.

The user may separate the endmost envelope from the roll and hold it in one hand with the envelope flap either opened incident to the separation, or readily openable merely by thumbing it open. No peeling, tearing or unzipping is involved. The user may then with the same hand tilt or further tilt the envelope to spill the contained wipe 20 into the user's other hand for use, or may employ his or her other hand to easily remove the wipe 20 and use it. The illustrated thumbholes or thumb notches may aid in grasping the wipe to remove it.

As indicated in FIG. 2, the towelettes or wipes 20 may be larger in area than the envelopes in which they fit, and may be folded on themselves for storage within the envelopes.

While FIGS. 1 and 2 suggest the presence of only a single towelette or wipe 20 in each envelope 16, two or more wipes may be contained in each envelope. For example, the second wipe in each envelope may be provided for washing the hands. Where more than one wipe is provided in each envelope and the wipes have different ingredients or are intended for different uses, they may be colored differently for identification.

Figure 3:
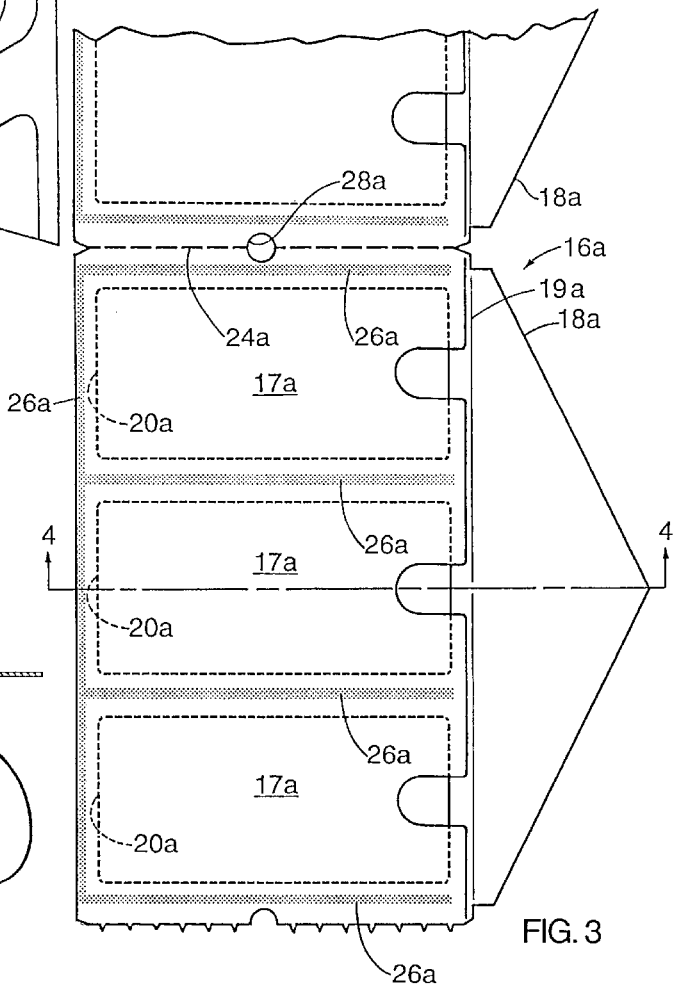
FIG. 3 is a plan view of a portion of unrolled product showing another embodiment of the invention.
Figure 4:
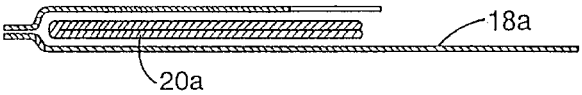
FIG. 4 is a diagrammatic cross-sectional view taken on line 4—4 of FIG. 2, but with the envelope flap open.

FIGS. 3 and 4 show an embodiment consisting of a train of envelopes 16*a* formed from two separate films sealed together at the left edge of the train (as viewed in the figures); each envelope is also sealed across its ends, and is also divided into three separate compartments 17*a* by two crosswise seals intermediate its ends, all as indicated by the pattern of seal lines 26*a* shown in the drawings. Each compartment 17*a* contains its own towelette or wipe 20*a*. The towelettes or wipes 20*a* for the three compartments of each envelope contain different agents, for example one may contain a skin cleanser, another a skin lotion, and the third a topically applied deodorizer.

When the endmost envelope 16*a* is separated and the flap 18*a* opens out around the hinge line 19*a*, all three wipes 20*a* are readily accessible and may be removed and used in the desired order.

The three compartments may be labelled by suitable legends printed on each compartment indicating the content of each, or giving use information for each. The wipe or wipes in each compartment may be colored differently than those in other compartments to distinguish between the contents of the compartments and to aid in using them in a proper sequence in any desired regimen.

The envelopes of toiletry rolls such as those shown in FIGS. 1–4 may be colored or decorated, and may be transparent or opaque. The flaps may be provided with color spots (not shown) at their centers to aid the user by suggesting a thumbing site for opening the envelopes.

Toiletry rolls such as shown in FIGS. 1–4 may be supported on a conventional relatively stiff cardboard or plastic core 40 or the like, and the inner end of the envelope train may be releasably or non-releasably adhered or otherwise fastened to the core. The core may in turn be mounted in a conventional manner, such as being mounted on the spring-loaded spindle 12 of FIG. 2. The spring within the spindle biases the spindle ends away from each other and into frictional engagement with their respective sockets on the fixture 14 or on a similar mounting. The core 40 lightly frictionally engages the spindle.

Figure 5:
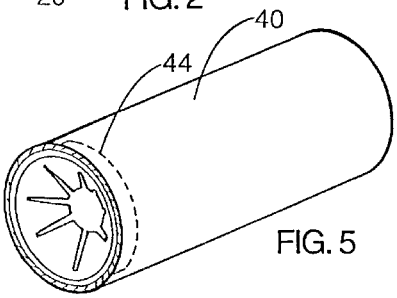
FIG. 5 is a slightly enlarged view of the core of the roll seen in FIG. 1.
Figure 6:
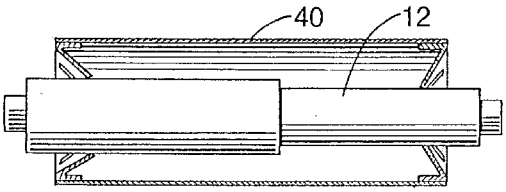
FIG. 6 is a cross-sectional view showing the core mounted on a conventional spring-loaded toilet roll spindle.

In order to somewhat increase frictional engagement between the core and spindle to resist any tendency for the roll to unwind or cascade due to weight of the envelopes and contents, gripper inserts 42 may be provided at the ends of the core 40, as shown in FIGS. 5 and 6. The inserts may be made of a suitable springy plastic. The illustrated gripper fingers engage over the ends of the spindle 14, as seen in FIG. 6. The inserts 42 are provided with flanges 44 which engage the inside wall of the core with a light press fit. The friction between the spindle and the core with the gripper inserts is greater than the friction in the absence of the inserts and resists self-unwinding of the roll. As seen in FIG. 6, the use of the gripper inserts also contributes to leveling of the roll on the spindle, whose two ends vary slightly in radius. Alternatively, the inserts 42 may be formed integrally with the core 40. The construction as shown also tends to prevent lateral wandering of the roll and centers the roll on the spindle for more accurate alignment of catching elements such as the catch 20 and holes 28 or 28*a*.

Toiletry rolls similar to those described may be provided in various sizes and in various width-to-length ratios of the individual envelopes. While it is contemplated that in some applications the rolls are mounted on the spindle of a dispenser such as a bathroom toilet roll fixture or the like, in other applications the "spindle" may be any suitable element capable of rotatively mounting the particular roll. For example, trains of envelopes similar to those described above (and whose individual envelopes may, or may not, be of relatively large dimension in either or both the transverse and longitudinal directions) may be received on such "spindles" as horizontal towel bars or the like, and may be used in various locales such as kitchens, laundries, and pantries as well as dressing rooms and bathrooms.

It should be evident that this disclosure is by way of example, and that various changes may be made by adding, modifying or eliminating features without departing from the fair scope of the teaching contained in this disclosure. The invention therefore is not to be limited to the particular details of this disclosure except to the extent that the following claims are necessarily so limited.

What is claimed is:

1. A toiletry roll suitable to be mounted on the spindle of a dispenser, the roll comprising envelopes formed of flexible polymeric moisture-resistant film material and arrayed end-to-end to form a train of envelopes each having a radially inner wall, a radially outer wall, and a closure flap, the said closure flap of each envelope being affixed to and extending from one of said walls of the envelope and being folded inwardly to envelope-closing position over and onto the exterior side of the other of said walls of the envelope, the train being wound on itself to form the roll, the closure flaps being held in envelope-closing position by the wound configuration of the roll, each closure flap, upon separation of its associated envelope from the roll, either opening incident to the separation or being readily openable by thumbing without peeling, tearing or unzipping each envelope containing at least one removable flushable wipe moistened with at least one skin-treating agent comprising skin cleaner.

2. A toiletry roll as in claim 1, said flap of each envelope being inwardly folded from one side edge of the envelope corresponding to one side face of the roll.

3. A toiletry roll as in claim 2, said envelopes being directly connected end-to-end, with said flexible film material which forms the envelopes extending between each envelope and the next successive envelope in said train.

4. A toiletry roll as in claim 3, the endmost envelope of said train being separable from its adjacent envelope to be removed from said train and held in one hand with the flap either falling open incident to the removal from the train readily openable by thumbing manipulation by one hand.

5. A toiletry roll as in claim 4 having at least one separation hole associated with the leading end of each envelope, said roll being carried by a dispenser which includes at least one finger for cooperating with the said at least one hole of the envelope immediately succeeding the endmost envelope to assist in the separation of the endmost envelope by manipulation with one hand.

6. A toiletry roll as in claim 2, said flap of each envelope being folded over the radially outer wall of the envelope.

7. A toiletry roll as in claim 1, the inner end of said train being fastened to a relatively stiff core around which the train is wrapped.

8. A toiletry roll as in claim 1, each envelope being divided into more than one compartment with each compartment containing its own removable flushable wipe, said compartments of each envelope being closed by the closure flap of the envelope when the flap is in said envelope-closing position.

* * * * *

UNITED STATES PATENT AND TRADEMARK OFFICE

CERTIFICATE OF CORRECTION

PATENT NO. : 5,971,138

DATED : October 26, 1999

INVENTOR(S) : John J. Soughan

It is certified that error appears in the above-indentified patent and that said Letters Patent is hereby corrected as shown below:

Claim 4, line 4 after "train" insert --or--.

Signed and Sealed this

Twenty-fifth Day of April, 2000

*Attest:*

*Attesting Officer*

Q. TODD DICKINSON

*Director of Patents and Trademarks*